US005227023A

United States Patent [19]

Pounder et al.

[11] Patent Number: 5,227,023

[45] Date of Patent: Jul. 13, 1993

[54] MULTI-LAYER PAPERS AND TISSUES

[75] Inventors: Joseph R. Pounder, Appleton; Frederick W. Ahrens, Hortonville; Thomas N. Kershaw, Neenah, all of Wis.

[73] Assignee: James River Corporation of Virginia, Richmond, Va.

[21] Appl. No.: 750,076

[22] Filed: Aug. 26, 1991

[51] Int. Cl.[5] ..... D21H 21/56

[52] U.S. Cl. ..... 162/101; 162/111; 162/112; 162/123; 162/125; 162/129; 162/130; 162/131

[58] Field of Search ..... 162/101, 123, 129, 130, 162/131, 125, 111, 112

[56] References Cited

U.S. PATENT DOCUMENTS

| | | | |
|---|---|---|---|
| 3,594,544 | 7/1971 | Wunderlich | 219/302 |
| 3,716,449 | 2/1973 | Gatward et al. | 162/101 |
| 3,871,952 | 3/1975 | Robertson | 162/101 |
| 3,954,554 | 5/1976 | Curry et al. | 162/104 |
| 3,994,771 | 11/1976 | Morgan, Jr. et al. | 162/111 |
| 4,038,445 | 7/1977 | Robertson | 427/150 |
| 4,300,981 | 11/1981 | Carstens | 162/131 |
| 4,344,818 | 8/1982 | Nuttall et al. | 162/111 |
| 4,349,414 | 9/1982 | Stenberg | 162/123 |
| 4,411,663 | 10/1983 | Lauchenauer | 8/107 |
| 4,443,297 | 4/1984 | Cheshire et al. | 162/101 |
| 4,606,944 | 8/1986 | Lauchenauer | 427/296 |
| 4,778,477 | 10/1988 | Lauchenauer | 8/477 |
| 5,102,501 | 4/1992 | Eber et al. | 162/129 |

*Primary Examiner*—Peter Chin

[57] ABSTRACT

Novel multi-layer paper and tissue products are provided, which possess strength, softness and absorbency. The products comprise either at least two foam deposited paper layers, wherein the foams have different air contents therein, or foam and water deposited layers. The layers can be deposited at about identical feed pressures from a single headbox while still possessing differing tensile strength ratios. Novel processes for forming such products are also provided.

9 Claims, 1 Drawing Sheet

TENSILE STRENGTH RATIOS

Calculated System Performance

MULTI-LAYER PAPERS AND TISSUES

BACKGROUND OF THE INVENTION

1. Field of the Invention

The present invention is concerned with providing new multi-layered paper and tissue products which contain foam deposited paper layers having different tensile strength ratios, and with providing products which contain both foam deposited and water deposited paper layers having different tensile strength ratios. The invention is also concerned with providing a novel process for the manufacture of such multi-layered paper and tissue products.

2. Discussion of Related Art

U.S. Pat. No. 3,716,449 of Gatward et al discloses a method and apparatus for preparing non-woven fibrous webs, including paper from a foamed aqueous furnish containing a surfactant. The disclosed method permits depositing foamed fibrous suspensions upon a previously formed mat. However, there is no disclosure of the formation of multi-layered paper or tissue containing multi-layered papers having foamed deposited layers possessing differing tensile strength ratios, and/or papers containing both foam and conventional aqueous deposited layers having differing tensile strength ratios. Likewise, there is no disclosure of functional advantages associated with such a product. U.S. Pat. No. 3,716,449 is expressly incorporated by reference herein.

U.S. Pat. No. 4,344,818 of Nuttall et al discloses a method of forming a multi-layered absorbent web containing in an inner layer thereof airborne fibers. The disclosed method utilizes a single headbox to deposit the different layers of the multi-layer absorbent web. The primary goal of Nuttall et al is to provide a multi-layer web having a significant portion of its fibers in a dry state so that less energy is required to dry the produced product. There is no disclosure of the formation of multi-layered products such as provided for herein, or of functional advantages associated with such products.

U.S. Pat. No. 4,349,414 of Stenberg discloses a method of producing a stratified jet of paper making stock, capable of creating a multi-layer web. The stratified jet initially contains separate jets of paper making stock, separated by wedge-shaped bodies of gaseous fluids. The purpose of providing such a stratified jet of paper stocks is disclosed as allowing one to produce a multi-layer web comprising a plurality of distinct layers intermingled only at adjoining layer surfaces. In one specific embodiment, Stenberg teaches that an appropriate foam stock layer can allow one to create a suitable wedge-shaped body of gaseous fluid, such as referred to above, so that layers of non-foamed stock can be prevented from mixing. Even so, the reference never produces multi-layered products such as occur in the present invention or recognizes the functional advantages associated with such products.

U.S. Pat. No. 3,594,544 of Curry et al discloses a method and apparatus for making a multi-ply paper sheet, wherein a first web is formed by wet laying fibers and a second layer is formed by dry-laying fibers, the two webs being combined to form a multi-ply sheet. There is not disclosed the use of a foam deposited layer(s), such as occurs in the present invention.

SUMMARY OF THE INVENTION

The present invention provides those skilled in the art with a new type of paper towel and/or tissue type multi-layer paper product which possesses high strength, while still maintaining good absorbency and softness. The present invention also allows for the production of a multi-layered paper product possessing greater bulk and absorbency than that of a conventional stratified towel or tissue paper product prepared using only water deposited fiber layers or layers having equal tensile strength ratios; and it provides a multi-layer paper product, having improved tensile strength over that of foam formed stratified paper products, wherein the different layers thereof have about identical tensile strength ratios.

The present invention also provides a method for producing such products while using but a single feed pressure for depositing each of the separate layers, so that a single headbox can advantageously be used, if desired. The present invention still further provides a method of preparing such a product so that an opportunity exists for a foam assisted dewatering of any water deposited layers that are present therein.

Novel paper products, which are encompassed by the present invention, include stratified and layered paper and tissue products which possess high strength, absorbency and softness. The paper and tissue products include at least one foam deposited paper layer, having a tensile strength ratio of $T_1$, and at least one foam deposited or water deposited paper layer, having a tensile strength ratio of $T_2$, wherein the foam deposited paper layer(s) and the water deposited paper layer(s) may be deposited at about identical feed pressures and $T_1$ is different from $T_2$. Tensile strength ratio is defined as the ratio of machine-direction tensile strength to cross-direction tensile strength.

Novel processes for preparing the paper products of the present invention, which are encompassed hereby, include depositing on suitable substrates a water deposited paper layer and a foam deposited paper layer, or depositing at least two foam layers (having different air contents therein) on suitable substrates.

BRIEF DESCRIPTION OF THE DRAWINGS

The present invention will become more fully understood from the detailed description given here and below and the accompanying drawing which is given by way of illustration only, and thus, is not limitative of the present invention, and wherein.

Figure 1:
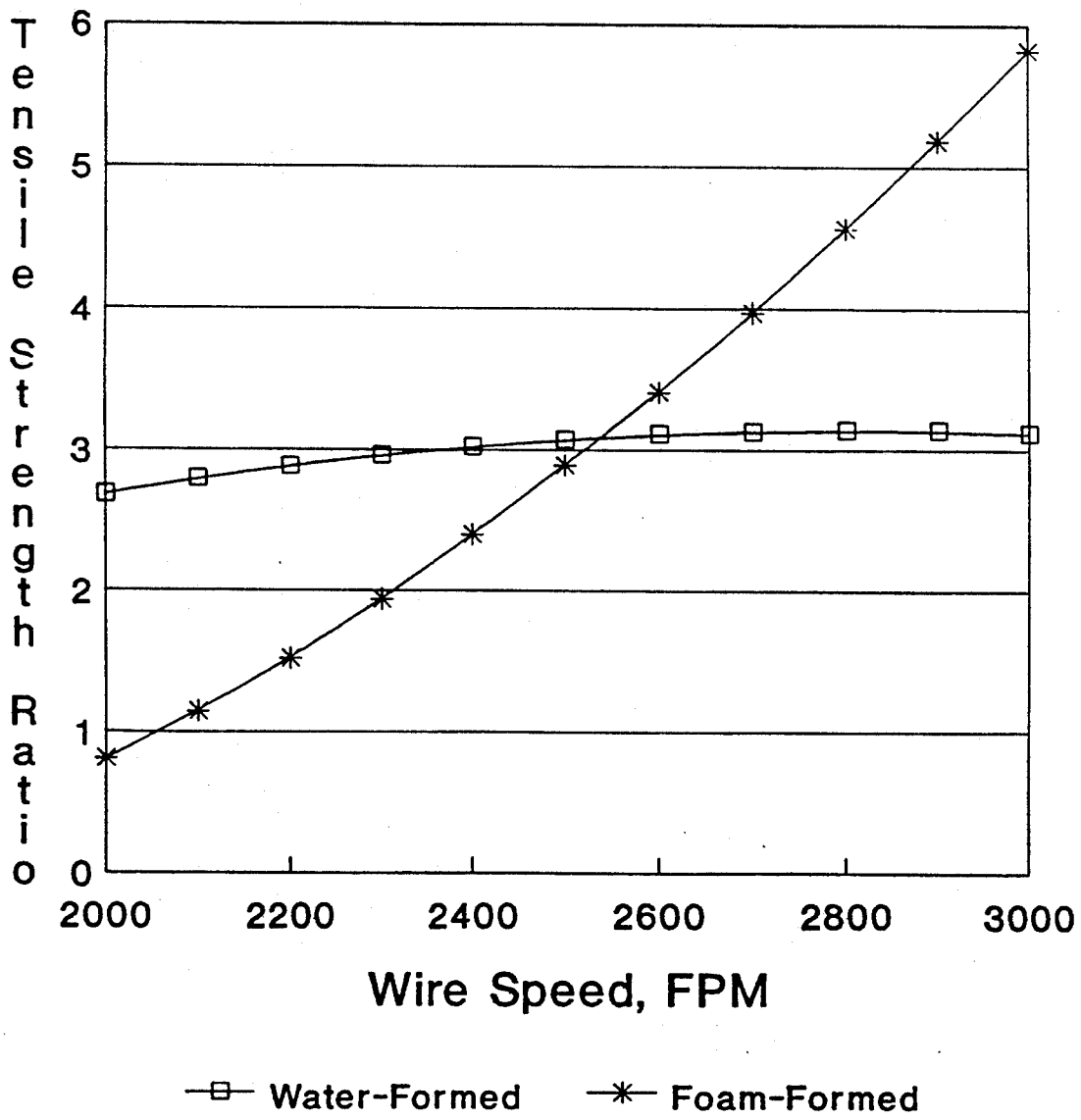
FIG. 1 : Graph showing expected tensile strength ratios for single layer papers having either water-deposited or foam-deposited layers, at different production speeds.

The data in FIG. 1 were calculated based on empirically developed mathematical models of water forming and foam forming system performance. The models were created from pilot-machine experiments conducted over wide ranges of wire speed, headbox slice opening, jet-speed-to-wire-speed ratio (J/W), and air content (for foam).

The curves in FIG. 1 were determined as follows: 1) one J/W for water forming was chosen for all wire speeds over the range of 2000 to 3000 fpm: 2) at each speed, the required headbox pressure was calculated, corresponding to the chosen water forming J/W; 3) the jet speed for foam forming was calculated, corresponding to the water forming headbox pressure; and 4) the tensile ratios for water forming and foam forming were calculated from the system performance models. In all cases, the headbox slice opening and foam air content were held constant.

DETAILED DESCRIPTION OF THE EMBODIMENT

The following detailed description is provided to aid those skilled in the art in practicing the present invention. However, the following description should not be deemed to unduly limit the present invention. This is particularly important to understand since minor variations in materials and procedures discussed herein may be easily made by those of ordinary skill in the art without departing from the spirit or scope of the present invention. Moreover, it is noted that the rights of the present inventors are only limited by the scope of claims appended hereto and the equivalents thereof.

Even though the presently disclosed inventive materials and the methods provided for their manufacture are novel, it is emphasized that certain techniques and materials already known to those skilled in the art are useful in providing the present inventive products and methods. Such techniques and materials will be referred to whenever possible so as to simplify the present inventive disclosure while not unduly burdening the reader.

Processes for depositing non-woven fibers in an aqueous suspension onto a foraminous support (usually called a wire) are well known. Once deposited, the aqueous suspension is allowed to drain, so that there is left a deposited layer of fibers on the support in the form of a wet web. Such layers are generally referred to herein as water (or aqueous) deposited layers.

In contrast to water deposited layers, there are also known processes for forming "foam deposited layers". Such layers are produced by depositing highly foamed aqueous suspensions containing surfactants and appropriate fibers on a suitable support. After deposition, the foamed suspensions are allowed to collapse and/or are drained so that there is formed a wet web of fibers on the support. Such layers are referred to herein as "foam deposited layers".

The term "foam deposited layer" as used herein, also means a layer formed from a highly foamed aqueous suspension having an air content therein of from 10 to 99%, desirably from 50 to 80% (v/v) and preferably from 60 to 70% (v/v); and the term "water deposited layer" also means a layer formed from an aqueous based suspension having an air content therein of less than 10%, preferably less than 5% (v/v). In this regard, there can be thought of a continuum between foam deposited layers and water deposited layers, with the air content (v/v %) of the furnish defining what type of deposition is taking place.

Realizing that those skilled in the art may be more familiar with water deposited paper layers than foam deposited paper layers, it is noted that several processes for preparing foam deposited layers are disclosed in U.S. Pat. No. 3,716,449 of Gatward et al and U.S. Pat. No. 3,871,952 of Robertson. Such references are incorporated by reference herein.

In the present inventive materials, it is expressly provided that there exists at least a first layer which is a foam deposited fiber layer, and at least a second layer which may be a water deposited fiber layer or foam deposited fiber layer. As such, any paper or tissue product encompassed by the present invention must possess at least two layers, the respective constituents of which may be the same or different. The following discussions relate to multi-layer paper materials which only contain two layers (i.e., two foam deposited layers or a foam deposited and a water deposited layer). Nonetheless, the following discussions are also equally applicable to other multi-layer papers encompassed hereby and thus should not be considered as limited to the two-layer papers and tissues discussed herein.

When forming a two-layer paper or tissue product containing both a foam deposited and a water deposited fibrous layer, it is thought preferable first to deposit the water deposited layer on a suitable support (e.g., a foraminous support), and thereafter deposit the foam layer on top of (or adjacent to) the water deposited layer. Such a procedure is thought preferred since it allows for easy drainage of the large volumes of water associated with the water deposited layer. Moreover, by depositing the water formed layer first, it may be possible to achieve a foam assisted dewatering of the layer (discussed below) once the foam layer is applied thereto.

In general, the water deposited layers of the paper and/or tissue products of the present invention may be applied to any suitable substrate using techniques well known to those skilled in the art. Exemplary of such techniques would be the use of a headbox, which delivers a suitable liquid suspension containing about 0.1 to 0.5% w/w of suitable paper and/or tissue forming fibers, at a suitable feed pressure up to 100 psi, depending on desired jet velocity, onto a foraminous substrate.

Drainage of the water deposited layer can start immediately after its deposition and can include gravitational means and/or forced drainage means (e.g., pressing, vacuuming, heating to create a phase change from liquid to vapor, etc.).

After the water layer has been applied to a suitable substrate and drainage of the layer started, in general, the foam deposited layer is then deposited on top of (or adjacent to) the water deposited layer, using techniques understood by those skilled in the art. For example, a foam formed layer can be applied to the top of a water deposited layer using a headbox, which delivers a suitable foam containing suspension, containing about 50 to 80% air v/v, about 50 to 20% water v/v, and about 0.1 to 3.0% w/w suitable paper fibers and a surfactant at a feed pressure up to 100 psi. A stratified, suction breast roll headbox can be employed to control the drainage of the various layers by adjusting the position of the vacuum box within the roll.

Once deposited, the foam layer is initially drained of about 70 to 85% of its water, preferably using at least some forced drainage (e.g., vacuum means). However, gravitational means can also be used to perform this initial drainage of water, and can likewise be used in combination with forced drainage means, if desired.

As stated above, one expected advantage of applying the foam deposited layer after the water deposited layer is that a foam assisted dewatering effect might be achieved. One way such an effect might be achieved is through the use of forced air or vacuum air means, which create a pressure differential across the still wet deposited paper layers. For example, if the water deposited layer is applied to a suitable foraminous surface first and a foam deposited paper layer placed on top thereof, a vacuum can be set up below the foraminous support and air drawn through both the foam and water deposited layers, thus forming a pressure differential. When appropriate amounts of air are present in the foam deposited layer and the size and number of bubbles present in the foam are appropriate, a good pressure differential can be created across the deposited layers, which in turn can cause the water deposited layer to drain at a faster rate than it might otherwise drain.

It is noted that several U.S. Patents, including U.S. Pat. No. 4,606,944 and 4,778,477 of Lauchenauer, discuss dewatering treatments, processes and devices which utilize the production of a foam to produce a dewatering/drying action. Many of the teachings of these references can be applicable to the present invention, when those practicing the present invention desire to achieve a foam assisted dewatering of a water deposited layer. U.S. Pat. Nos. 4,606,944 and 4,778,477 are expressly incorporated by reference herein.

Once each of the water deposited and foam deposited layers are deposited on suitable substrates and an initial drainage of water in the layers takes place, various known steps in the paper making and/or tissue making arts can easily be performed upon the same. Such steps may include further dewatering by forced means or other steps, such as calendering, rolling, creping and cutting. The products produced using such additional steps are, of course, encompassed by the present invention.

The multi-layered paper and tissue products encompassed by the present invention which contain both water and foam deposited layers may be prepared by applying both the foam deposited and water deposited layers at about identical feed pressures, so that only one headbox type apparatus is required in their manufacture. In this regard, the single headbox should be segmented or compartmentalized for the receipt of the different foamed o water suspensions used to make the different paper or tissue layers present in the layered products of the present invention.

Regarding the use of a single headbox to prepare the paper and tissue products of the present invention, it is known that each compartment of certain types of multi-layer head-boxes must be operated at substantially the same pressure, regardless of the forming mediums, in order to avoid fluctuation of separator plates. Thus, these types of headboxes are required to use a nearly equivalent headbox pressure, which up to now has limited the ability of those skilled in the art to produce multi-layer products, the layers of which can possess different tensile strength ratios, with these types of headboxes. This problem, of course, is solved with the present invention.

In much the same way as two-layer products containing a water deposited and foam deposited layer are prepared, there can also be prepared a two-layer product encompassed hereby which contains two foam layers having different tensile strength ratios. However, with products containing two foam formed layers there is much greater latitude in deciding which layer should be deposited first, since the water contents of the respective foams should not differ greatly. Even so, it is thought preferable if the foam formed layer containing the largest percentage of water (v/v) is deposited first, so that the water therein may begin to drain immediately before the second layer is layered on top thereof or adjacent thereto.

When papers and/or tissue products according to the present invention are produced, even when using a single headbox pressure for the deposited layers therein, the differentially or similarly produced layers can possess different tensile strength ratios, even though the types and amounts of paper making fibers in the respective layers can be essentially identical and equal. For example, in the instance of similarly formed foam deposited layers, the inventors have discovered that when one-layer sheets of paper or tissue are manufactured at high production speeds ($\approx >2000$ fpm) from foam formed layers, they can possess different tensile strength ratios as a result of different air contents in the foam furnishes used to form the sheets. This is true even when the foams are fed onto suitable supports at about identical feed pressures. Similarly, the present inventors have also discovered that when foam formed one-layer sheets manufactured at high production speeds are compared to water deposited one-layer sheets manufactured at the same high production speeds and identical headbox pressures, the foam deposited layer sheets possess higher tensile strength ratios (see FIG. 1). Such properties of the different foam layers and/or the different foam and water deposited layers in the paper and/or tissue products of the present invention fortuitously allow the products encompassed herein to be strong, while at the same time being soft and absorbent.

There are also provided in the present invention processes for the manufacturing of the paper and tissue multi-layered products, encompassed hereby. The processes each involve the deposition of the differently or similarly formed layers. Such layer deposition may occur at about identical feed pressures, so that the products of the present invention can be prepared using a single multi-layer headbox, if desired.

While the paper and tissue making processes encompassed by the present invention comprise the step of depositing on suitable substrates at about identical feed pressures water deposited paper layer(s) and/or foam deposited paper layer(s), other steps, such as drying, pressing, calendering, sizing, creping, etc., can also be performed on the deposited layers without departing from the spirit or scope of the present invention.

Regarding results shown in FIG. 1 and the experimental procedures which were followed by the present inventors in obtaining a water deposited sheet and a foam deposited sheet, the following Experimental Section is provided to further aid those skilled in the art in practicing the present invention.

EXAMPLE 1

The present inventors have experimentally determined that when fibers from a foam deposited layer are deposited at a certain headbox (feed) pressure and are formed into sheets, the same sheets possess different tensile strength ratios than similar water deposited sheets which are deposited at the same headbox pressure.

Such results indicate that the multi-layer paper and tissue products of the present invention possess layers having differing tensile strength ratios, even when produced at identical feed pressures.

EXAMPLE 2

High-speed tests were conducted with a furnish of 67% SWK/33% HWK in which the SWK was refined separately to about 550 CSF. Sheets at a basis weight of about 8.5 lb/3000 $ft^2$ were made. Operating at a wire speed of 3000 fpm, there was produced a water deposited sheet having a tensile strength ratio of 3.1. A foam deposited sheet (deposited at the same headbox pressure as the water deposited sheet) had a tensile strength ratio of about 5.8. Moreover, at the same wire speed (3,000 fpm), a sheet deposited from a foam having a 56% v/v air content had a tensile strength ratio of 3.1 only when the headbox pressure was reduced by 30%.

The above results still further evidence that the present inventive paper and tissue products contain differentially formed layers, which possess different tensile strength ratios, even if deposited at identical feed pressures.

EXAMPLE 3

Two separate foam furnishes of paper making fibers were prepared, with the only difference therebetween being the air content (AC) therein.

The first foam furnish was calculated to contain 60% air v/v and the second foam furnish was calculated to contain 64% air v/v. When the two foam furnishes were delivered to an identical rectangular headbox, under the following pressures (20 and 30 psig), the following jet velocities of each furnish from the headbox were determined:

| AC | p = 20 psig | p = psig |
|---|---|---|
| 60% | 4564 fpm | 5401 fpm |
| 64% | 4765 fpm | 5621 fpm |

Based upon such values, it is expected that multilayer paper and tissue type products having layers possessing different tensile strength ratios can be prepared from foam furnishes containing different air contents, even when deposited from the same headbox at equal feed pressures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process of forming a stratified and layered paper product possessing desirable strength, absorbency and softness comprising the following steps:

depositing at least two layers of furnish from corresponding sections of a single stratified headbox to form a web;

supplying at least one furnish to said corresponding section of said single stratified headbox for forming at least one layer;

supplying at least a second furnish to said corresponding section of said single stratified headbox for forming at least a second layer containing an air content in the range of approximately 10 to 99% and containing a sufficient surfactant for rendering the furnish foamable, the air content of said at least one furnish being different as compared to the air content of said second layer by approximately at least 4%, the difference in the air content of said first and second layers being sufficiently different for providing an expected tensile ratio of the first and second layers to differ by at least 25%; and applying substantially equivalent pressure to each section of said single stratified headbox for discharging the respective furnishes therefrom.

2. The process of forming a stratified and layered paper product possessing desirable strength, absorbency and softness according to claim 1, wherein the air content in said at least said second layer is in the range of approximately 50 to 80%.

3. The process of forming a stratified and layered paper product possessing desirable strength, absorbency and softness according to claim 1, wherein the air content in said at least said second layer is in the range of approximately 60 to 70%.

4. The process of forming a stratified and layered paper product possessing desirable strength, absorbency and softness according to claim 1, wherein the air content in said at least said second layer is approximately 60% and the air content in said first layer is approximately 64%.

5. The process of forming a stratified and layered paper product possessing desirable strength, absorbency and softness according to claim 1, wherein the furnish of said at least one layer and at least said second layer is approximately 67% softwood kraft and approximately 33% hardwood kraft.

6. The process of forming a stratified and layered paper product possessing desirable strength, absorbency and softness according to claim 1, where the at least one furnish is deposited first.

7. A paper product made according to the process of claim 1.

8. A paper towel product made according to the process of claim 1.

9. A paper tissue product made according to the process of claim 1.

* * * * *